US009254849B1

(12) United States Patent
Green

(10) Patent No.: US 9,254,849 B1
(45) Date of Patent: Feb. 9, 2016

(54) DEVICE AND METHOD FOR INTERFACING WITH A LOCOMOTIVE ENGINE

(71) Applicant: Jason Green, Davie, FL (US)

(72) Inventor: Jason Green, Davie, FL (US)

(73) Assignee: Gaseous Fuel Systems, Corp., Weston, FL (US)

( * ) Notice: Subject to any disclaimer, the term of this patent is extended or adjusted under 35 U.S.C. 154(b) by 0 days.

(21) Appl. No.: 14/508,459

(22) Filed: Oct. 7, 2014

(51) Int. Cl.
*G05D 1/00* (2006.01)
*B61C 17/00* (2006.01)

(52) U.S. Cl.
CPC ..... *B61C 17/00* (2013.01)

(58) Field of Classification Search
CPC ..... B61C 17/12
See application file for complete search history.

(56) References Cited

U.S. PATENT DOCUMENTS

| | | | | |
|---|---|---|---|---|
| 3,866,781 | A | 2/1975 | Stedman et al. | |
| 4,006,852 | A | 2/1977 | Pilsner et al. | |
| 4,078,629 | A | 3/1978 | Kutay et al. | |
| 4,234,922 | A * | 11/1980 | Wilde et al. | 701/20 |
| 4,288,086 | A | 9/1981 | Oban et al. | |
| 4,335,697 | A | 6/1982 | McLean | |
| 4,415,051 | A | 11/1983 | Taylor | |
| 4,442,665 | A | 4/1984 | Fick et al. | |
| 4,489,699 | A | 12/1984 | Poehlman | |
| 4,499,885 | A | 2/1985 | Weissenbach | |
| 4,522,159 | A | 6/1985 | Engel et al. | |
| 4,527,516 | A | 7/1985 | Foster | |
| 4,535,728 | A | 8/1985 | Batchelor | |
| 4,603,674 | A | 8/1986 | Tanaka | |
| 4,606,322 | A | 8/1986 | Reid et al. | |
| 4,617,904 | A | 10/1986 | Pagdin | |
| 4,641,625 | A | 2/1987 | Smith | |
| 4,708,094 | A | 11/1987 | Helmich et al. | |
| 4,770,428 | A | 9/1988 | Sugiyama | |
| 4,799,565 | A | 1/1989 | Handa et al. | |
| 4,817,568 | A | 4/1989 | Bedford | |
| 4,861,096 | A | 8/1989 | Hastings | |

(Continued)

FOREIGN PATENT DOCUMENTS

| | | |
|---|---|---|
| CA | 2741263 | 10/2014 |
| WO | WO 02/101214 | 12/2002 |

(Continued)

OTHER PUBLICATIONS

GFS Corp., First LNG Mining Truck in U.S. [online press release]. Oct. 21, 2010. Retrieved from the internet on Oct. 25, 2012: http://www.d2ginc.com/PDF/First%20LNG%20Mining%20Truck%20In%20US%20Press%20Kit%20Oct%2021.pdf.

(Continued)

*Primary Examiner* — Michael D Lang
(74) *Attorney, Agent, or Firm* — Malloy & Malloy, P.L.

(57) ABSTRACT

An device and attendant method for interfacing with a locomotive engine. An illustrative embodiment of the device includes at least one sensor disposed in a sensing relationship with a relay bank of the locomotive engine. The sensor is structured for determination of a state of the relay bank. The sensor is further structured to determine a corresponding throttle notch position of the locomotive engine from the state of the relay bank. The device also includes at least one indicator in a communicating relationship with said one sensor. The indicator is structured to indicate the corresponding throttle notch position. The present invention further relates to a method for interfacing with a locomotive engine.

11 Claims, 5 Drawing Sheets

(56) References Cited

U.S. PATENT DOCUMENTS

| | | | |
|---|---|---|---|
| 4,955,326 | A | 9/1990 | Helmich |
| 5,033,567 | A | 7/1991 | Washburn et al. |
| 5,050,550 | A | 9/1991 | Gao |
| 5,054,799 | A | 10/1991 | Fingerle |
| 5,081,969 | A | 1/1992 | Long, III |
| 5,092,305 | A | 3/1992 | King |
| 5,156,230 | A | 10/1992 | Washburn |
| 5,215,157 | A | 6/1993 | Teich |
| 5,224,457 | A | 7/1993 | Arsenault et al. |
| 5,355,854 | A | 10/1994 | Aubee |
| 5,370,097 | A | 12/1994 | Davis |
| 5,375,582 | A | 12/1994 | Wimer |
| 5,379,740 | A | 1/1995 | Moore et al. |
| 5,518,272 | A | 5/1996 | Fukagawa et al. |
| 5,526,786 | A | 6/1996 | Beck et al. |
| 5,546,908 | A | 8/1996 | Stokes |
| 5,566,653 | A | 10/1996 | Feuling |
| 5,566,712 | A | 10/1996 | White et al. |
| 5,593,167 | A | 1/1997 | Barnhardt et al. |
| 5,598,825 | A | 2/1997 | Neumann |
| 5,609,037 | A | 3/1997 | Fischler |
| 5,701,928 | A | 12/1997 | Aoki |
| 5,735,253 | A | 4/1998 | Perotto et al. |
| 5,794,979 | A | 8/1998 | Kasuga et al. |
| 5,806,490 | A | 9/1998 | Nogi et al. |
| 5,810,309 | A | 9/1998 | Augustine et al. |
| 5,845,940 | A | 12/1998 | Colburn |
| 5,937,800 | A | 8/1999 | Brown |
| 5,996,207 | A | 12/1999 | Brown |
| 6,003,478 | A | 12/1999 | Huber |
| 6,041,762 | A | 3/2000 | Sirosh et al. |
| 6,101,986 | A | 8/2000 | Brown |
| 6,151,547 | A | 11/2000 | Kumar et al. |
| 6,168,229 | B1 | 1/2001 | Kooi et al. |
| 6,250,260 | B1 | 6/2001 | Green |
| 6,250,723 | B1 | 6/2001 | Barberis et al. |
| 6,289,881 | B1 | 9/2001 | Klopp |
| 6,513,485 | B2 | 2/2003 | Ogawa et al. |
| 6,543,395 | B2 | 4/2003 | Green |
| 6,550,811 | B1 | 4/2003 | Bennett et al. |
| 6,676,163 | B2 | 1/2004 | Joitescu et al. |
| 6,718,952 | B2 | 4/2004 | Finch |
| 6,751,835 | B2 | 6/2004 | Fenton |
| 6,863,034 | B2 | 3/2005 | Kern et al. |
| 6,875,258 | B2 | 4/2005 | Kuperus |
| 6,938,928 | B2 | 9/2005 | Pfohl et al. |
| 7,019,626 | B1 | 3/2006 | Funk |
| 7,270,209 | B2 | 9/2007 | Suess |
| 7,299,122 | B2 | 11/2007 | Perkins |
| 7,334,818 | B2 | 2/2008 | Mascarenhas et al. |
| 7,341,164 | B2 | 3/2008 | Barquist |
| 7,410,152 | B2 | 8/2008 | Yates |
| 7,444,986 | B2 | 11/2008 | Shute |
| 7,607,630 | B2 | 10/2009 | Jung et al. |
| 7,775,311 | B1 | 8/2010 | Hardy et al. |
| 7,874,451 | B2 | 1/2011 | Bell |
| 7,976,067 | B2 | 7/2011 | Naganuma et al. |
| 8,005,603 | B2 | 8/2011 | Fisher et al. |
| 8,282,132 | B2 | 10/2012 | Griesbaum |
| 8,498,799 | B2 | 7/2013 | Matthews, Jr. et al. |
| 8,534,403 | B2 | 9/2013 | Pursifull |
| 8,550,274 | B2 | 10/2013 | Gerding |
| 8,556,107 | B2 | 10/2013 | McRobbie et al. |
| 8,820,289 | B2 | 9/2014 | Green |
| 8,881,933 | B2 | 11/2014 | Green |
| 8,882,071 | B2 | 11/2014 | Green |
| 9,031,763 | B2 | 5/2015 | Green |
| 2001/0037549 | A1 | 11/2001 | Fenton |
| 2002/0017088 | A1 | 2/2002 | Dillon |
| 2002/0029770 | A1 | 3/2002 | Heffel et al. |
| 2002/0030397 | A1 | 3/2002 | Tamura et al. |
| 2002/0078918 | A1 | 6/2002 | Ancimer et al. |
| 2003/0178422 | A1 | 9/2003 | Kosuge et al. |
| 2003/0187565 | A1 | 10/2003 | Wong |
| 2004/0011050 | A1 | 1/2004 | Inoue |
| 2004/0140412 | A1 | 7/2004 | Hendzel et al. |
| 2004/0148086 | A1 | 7/2004 | Tafazoli et al. |
| 2005/0121005 | A1 | 6/2005 | Edwards |
| 2005/0230579 | A1 | 10/2005 | Mascarenhas et al. |
| 2006/0033322 | A1 | 2/2006 | Suess |
| 2008/0023957 | A1 | 1/2008 | Diehl |
| 2008/0042028 | A1 | 2/2008 | Ross |
| 2009/0152043 | A1 | 6/2009 | Lee |
| 2009/0320786 | A1 | 12/2009 | Fisher |
| 2010/0045017 | A1 | 2/2010 | Rea |
| 2010/0055156 | A1 | 3/2010 | Ross |
| 2010/0078244 | A1 | 4/2010 | Pursifull |
| 2010/0127002 | A1 | 5/2010 | Bel |
| 2011/0202256 | A1 | 8/2011 | Sauve et al. |
| 2012/0001743 | A1 | 1/2012 | Cotton et al. |
| 2012/0060800 | A1 | 3/2012 | Green |
| 2012/0067660 | A1 | 3/2012 | Kashu et al. |
| 2012/0112533 | A1 | 5/2012 | Yarmak et al. |
| 2012/0310509 | A1 | 12/2012 | Pardo et al. |
| 2012/0325355 | A1 | 12/2012 | Docheff |
| 2013/0068905 | A1 | 3/2013 | Green |
| 2013/0069357 | A1 | 3/2013 | Green |
| 2013/0074816 | A1 | 3/2013 | Green |
| 2013/0092694 | A1 | 4/2013 | Green |
| 2013/0112768 | A1 | 5/2013 | Hagenbuch |
| 2013/0245864 | A1 | 9/2013 | Frazier et al. |
| 2014/0053800 | A1 | 2/2014 | Steffen et al. |
| 2014/0060946 | A1 | 3/2014 | Willi |
| 2014/0196687 | A1 | 7/2014 | Coldren et al. |
| 2015/0000643 | A1 | 1/2015 | Green |
| 2015/0020770 | A1 | 1/2015 | Green |
| 2015/0025774 | A1 | 1/2015 | Green |

FOREIGN PATENT DOCUMENTS

| | | |
|---|---|---|
| WO | WO 2008/037175 | 4/2008 |
| WO | WO 2012/036768 | 3/2012 |
| WO | WO 2013/039708 | 3/2013 |
| WO | WO 2013/048812 | 4/2013 |
| WO | WO 2013/058988 | 4/2013 |

OTHER PUBLICATIONS

Caterpillar 785C Mining Truck Spec Sheet, 2010.

* cited by examiner

FIG. 4

| | Notch | AV (11) | BV (12) | CV (13) | DV (14) | |
|---|---|---|---|---|---|---|
| 1010 → | 1 | 0 | 0 | 0 | 0 | ← 2010 |
| 1020 → | 2 | 1 | 0 | 0 | 0 | ← 2020 |
| 1030 → | 3 | 0 | 0 | 1 | 0 | ← 2030 |
| 1040 → | 4 | 1 | 0 | 1 | 0 | ← 2040 |
| 1050 → | 5 | 0 | 1 | 1 | 1 | ← 2050 |
| 1060 → | 6 | 1 | 1 | 1 | 1 | ← 2060 |
| 1070 → | 7 | 0 | 1 | 1 | 0 | ← 2070 |
| 1080 → | 8 | 1 | 1 | 1 | 0 | ← 2080 |

1000 →

DEVICE AND METHOD FOR INTERFACING WITH A LOCOMOTIVE ENGINE

BACKGROUND OF THE INVENTION

1. Field of the Invention

The present invention relates to a device and method for determination of the throttle notch position of a locomotive engine.

2. Description of the Related Art

A locomotive engine typically features complex systems to facilitate control of the various operative features of the engine, including equally complex electrical systems. Included in the plethora of functions that must be managed by a locomotive control system are those relating to the various throttle positions that may be selected for operation of the locomotive engine. Historically, the throttle positions, particularly within older models of locomotive engines, have been obfuscated with relay banks of the locomotive engine control systems.

Further, many engines, including locomotive engines, feature a plurality of selectable and substantially discrete throttle positions, any one of which may be selected, i.e. "operative" at a particular time. However, it may be difficult to determine, particularly in the case of older hardware, which of a plurality of selectable throttle positions is the one that is operative.

Accordingly, and particularly in light of the growth and reliance upon various forms of electronic data, a need has developed for exposing the status of functions of the locomotive engine, such as for processing by additional systems and/or the addition of analytics to the locomotive engine. This includes the need to determine the operative throttle notch position, such as through an interface device configured to sense the state of the relay bank. Such an interface device may be further configured to output information pertaining to the operative throttle notch position, such as but not limited to for further computational and/or analytical purposes.

SUMMARY OF THE INVENTION

The present invention relates to an interface device for determination of the throttle notch position currently selected, i.e. "operative," on a locomotive engine. The throttle notch position that is operative is the throttle notch position currently selected from a plurality of selectable throttle notch positions.

The interface device is disposed in a communicative relationship with a relay bank of the locomotive engine. Further, the interface device is configured to sense a "state" of the relay bank. An example of a state of the relay bank relates to the particular state of at least one, but preferably a plurality, of "switches" associated with the relay bank. Each switch comprises an on state and an off state, each of which may be associated with a logical value of logic 1 and logic 0, respectively. Accordingly, the collective state of the switches represents the state of the relay bank. Each operative throttle notch position of the locomotive engine causes the relay bank to enter a different state. Accordingly, sensing of the state of the relay bank facilitates determination of the operative throttle notch position of the locomotive engine.

The interface device may comprise a sensor configured to sense the state of the relay bank. The sensor is disposed in a communicative relationship with the relay bank. Furthermore, the sensor may be disposed in an electrical conducting relationship with various components of the relay bank, such as at least one but preferably a plurality of switches associated with the relay bank. Accordingly, the sensor may be configured to sense the state of the relay bank by measuring current, voltage and/or other electrical properties associated with the relay switch or relay switches. Such properties associated with the relay switch facilitate determination of the state of the relay switch, i.e. whether the switch is in an on state or off state, and therefore whether the switch can be mapped to logic 1 or logic 0 respectively. As stated above, the collective state or states of the switch or switches is representative of the state of the relay bank.

Upon sensing the state of the relay bank, the interface device determines the operative throttle notch position. As explained in detail herein, a preferred embodiment of the interface device is configured for determination of the operative throttle notch position of a locomotive engine identified as a General Electric 7FDL Engine. Accordingly, upon sensing a particular state of the relay bank, the interface device is configured to determine the operative throttle notch position of the General Electric 7FDL Engine. However, it should be appreciated that the interface device is not limited to this particular model of locomotive engine, and as such various embodiments of the interface device may be configured for determination of the operative throttle notch position of any suitable engine and/or locomotive engine consistent with the disclosure herein.

Various embodiments of an interface device are further configured to indicate the operative throttle notch position, for example by generating an output representative of the operative throttle notch position. This output may be utilized by and/or otherwise facilitate the functioning of, for example, other components of a control system, such as an Engine Control System (ECS).

The present invention is further directed toward a method of determining an operative throttle notch position.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 4 is a chart of logical values associated with relay switches and throttle notch positions in accordance with an illustrative embodiment of the present invention.

Like reference numerals refer to like parts throughout the several views of the drawings.

DETAILED DESCRIPTION OF THE PREFERRED EMBODIMENT

The present invention is generally directed to an interface device structured for determination of an operative throttle notch position of a locomotive engine. With reference to FIG.

1, the interface device is generally indicated at 1. Further, the interface device 1 is in communication with the locomotive engine, and preferably the relay bank 100 of the locomotive engine. The interface device 1 may further be in communication with a control system 200, such as an Engine Control System, that facilitates control of the engine.

Figure 1:
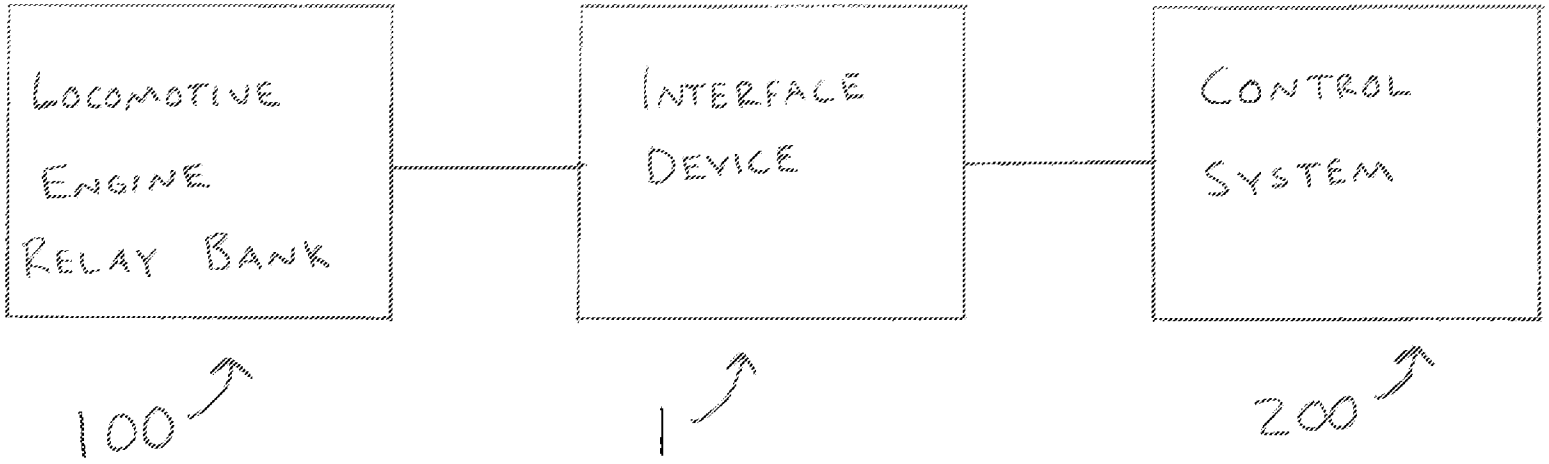
FIG. 1 is a schematic representation of one illustrative embodiment of an interface device in accordance with the present invention.
Figure 2:
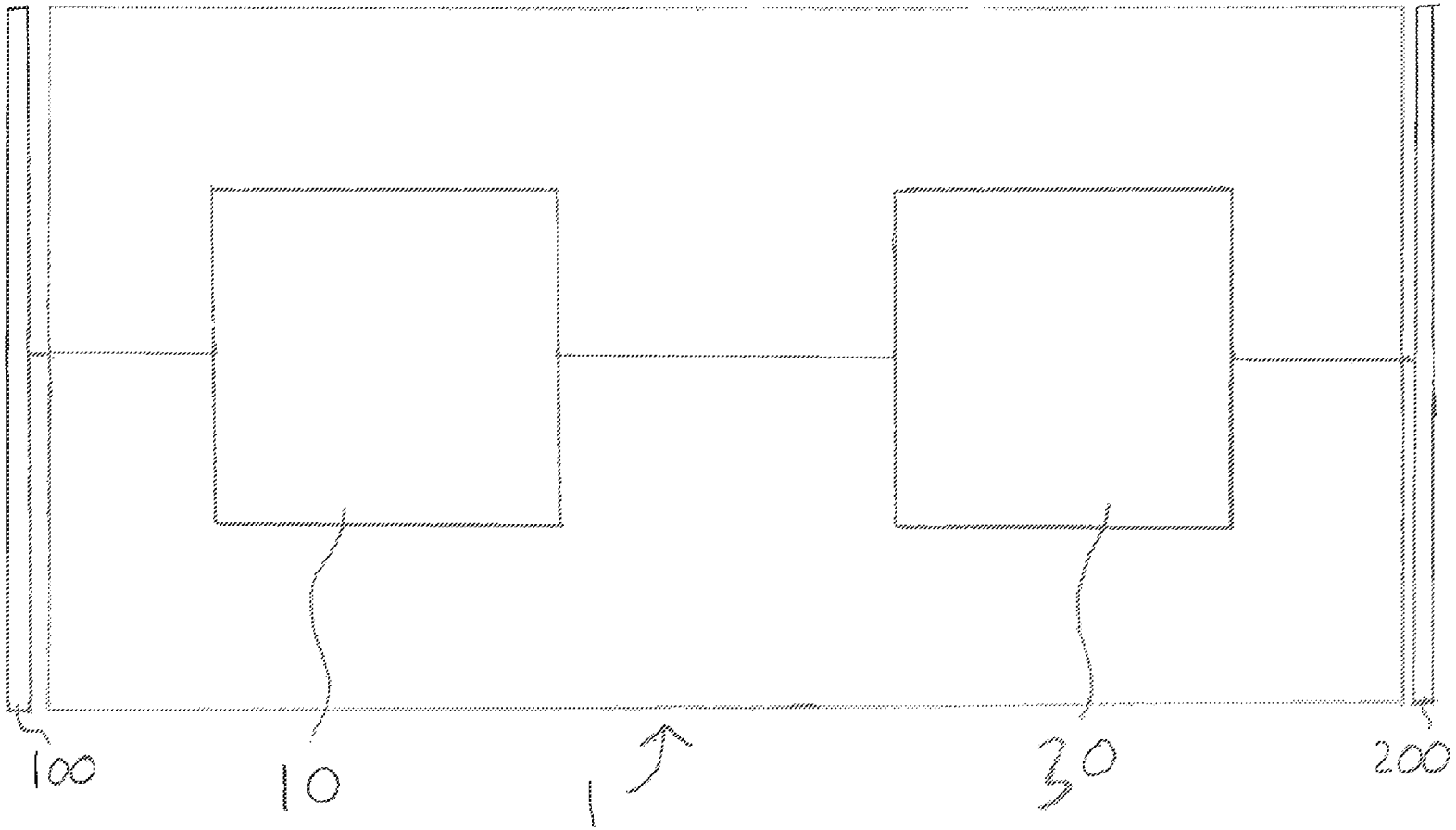
FIG. 2 is a schematic representation of one illustrative embodiment of an interface device, and components thereof, in accordance with the present invention.

With reference to FIG. 2, the depicted embodiment of the interface device 1 comprises at least one sensor 10 and at least one indicator 30. The sensor 10 is disposed in a communicating relationship with the indicator 30.

Figure 3:
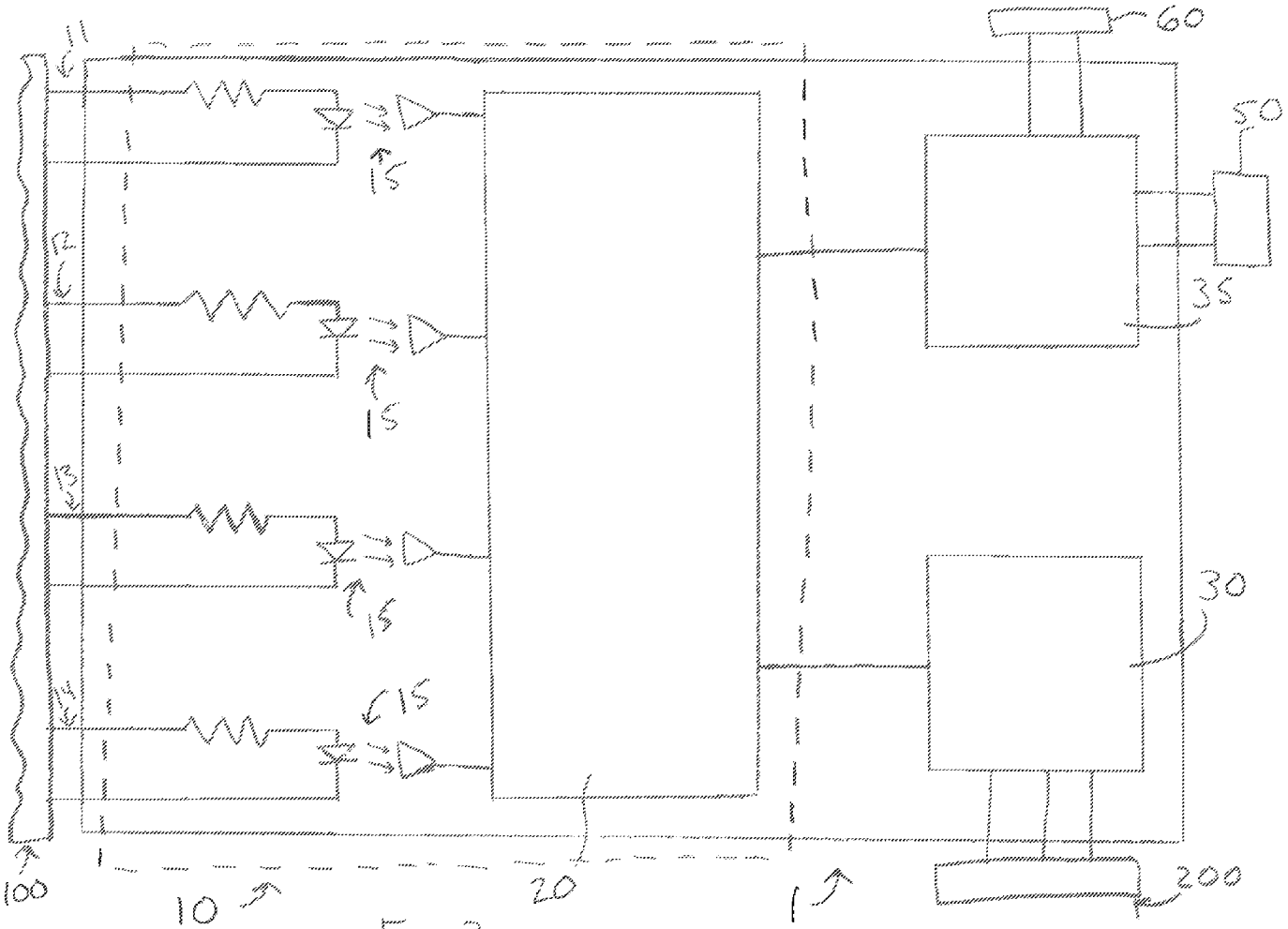
FIG. 3 is a schematic representation of one illustrative embodiment of an interface device, and components thereof, in accordance with the present invention.

With reference to FIG. 3, in the depicted embodiment the sensor 10 is disposed in a sensing relationship with the relay bank 100 and is structured for determination of a state of the relay bank 100. In an example of a state of the relay bank, the relay bank comprises at least one, but preferably a plurality, off "switches" 11, 12, 13, 14. Each switch 11, 12, 13, 14 comprises an on and an off state. The sensor 10 is structured to determine the operative state of each of the switches 11, 12, 13, 14, and accordingly sense the state of the relay bank. This may be accomplished, such as shown in the embodiment of FIG. 3, by disposing a plurality of optical isolators 15 of the sensor 10 each in a current sensing relationship with a corresponding one of the plurality of switches 11, 12, 13, 14. Each optical isolator 15 senses a voltage associated with the corresponding switch 11, 12, 13, 14. Accordingly, if the voltage sensed by an optical isolator 15 is within a first predetermined range, such as 0 to 25 volts, the switch 11, 12, 13, 14 is determined to be off. If the voltage sensed by an optical isolator 15 is within a second predetermined range, such as 58 to 72 volts, the switch 11, 12, 13, 14 is determined to be on.

Further, the sensor 10 may be configured to assign a switch 11, 12, 13, 14 that is operative in the "on" state to a value of logical 1, and a switch 11, 12, 13, 14 that is operative in the "off" state to a value of logical 0. This may be further understood if taken in accordance with the chart 1000 of FIG. 4. The chart 1000 depicts an embodiment of a plurality of relay bank states 2010-2080, each associated with a corresponding notch position 1010-1080. Accordingly, each relay bank state 2010-2080 comprises four switch states labelled AV 11, BV 12, CV 13 and DV 14, respectively.

Accordingly, the sensor 10 of FIG. 3 senses voltages and associates them with corresponding logical values, i.e. logical 1 for a switch that is "on" and logical 0 for a switch that is "off." With further reference to FIG. 4, the state of the relay bank 2010 indicative of a first throttle notch position 1010 is the value "0000," wherein the state of AV 11, BV 12, CV 13 and DV 14 are each logical 0. Stated another way, the sensor 10 is structured to determine that the first throttle position 1010 is the operative throttle position of the locomotive engine upon sensing that the state of the relay bank 2010 is "0000" by sensing that each of AV 11, BV 12, CV 13 and DV 14 are "off."

The sensor 10 may be further structured to determine that the second throttle position 1020 is the operative throttle position of the locomotive engine upon sensing that the state of the relay bank 2020 is "1000" by sensing that AV 11 is "on" and each of BV 12, CV 13 and DV 14 are "off."

The sensor 10 may be further structured to determine that the third throttle position 1030 is the operative throttle position of the locomotive engine upon sensing that the state of the relay bank 2030 is "0010" by sensing that CV 13 is "on" and each of AV 11, BV 12 and DV 14 are "off."

The sensor 10 may be further structured to determine that the fourth throttle position 1040 is the operative throttle position of the locomotive engine upon sensing that the state of the relay bank 2040 is "1010" by sensing that AV 11 and CV 13 are "on" and BV 12 and DV 14 are "off."

The sensor 10 may be further structured to determine that the fifth throttle position 1050 is the operative throttle position of the locomotive engine upon sensing that the state of the relay bank 2050 is "0111" by sensing that AV 11 is "off" and each of BV 12, CV 13 and DV 14 are "on."

The sensor 10 may be further structured to determine that the sixth throttle position 1060 is the operative throttle position of the locomotive engine upon sensing that the state of the relay bank 2060 is "1111" by sensing that AV 11, BV 12, CV 13 and DV 14 are "on."

The sensor 10 may be further structured to determine that the seventh throttle position 1070 is the operative throttle position of the locomotive engine upon sensing that the state of the relay bank 2070 is "0110" by sensing that AV 11 and DV 14 are "off" and BV 12 and CV 13 are "on."

The sensor 10 may be further structured to determine that the eighth throttle position 1080 is the operative throttle position of the locomotive engine upon sensing that the state of the relay bank 2080 is "1110" by sensing that DV 11 is "off" and each of AV 11, BV 12 and CV 13 are "on."

With reference to FIG. 3, the sensor 10 may comprise an encoder 20. The encoder 20 may be structured to associate a particular state of the relay bank 100 with the operative throttle notch position.

Moreover, upon determination of an operative throttle notch position, the interface device 1 is structured for the output of information pertaining to the operative throttle notch position. Accordingly, the interface device 1 may comprise an indicator 30. The indicator 30 is structured to indicate the operative throttle notch position that corresponds to the state of the relay bank 100 as determined by the sensor 10. The indicator 30 may output this information in any appropriate form, such as in the form of a digital output. Further, the indicator 30 may be disposed in a communicating relationship with a control system 200, such as an Engine Control System (ECS). The control system 200 may be structured to further utilize the indicated operative throttle notch position, such as for control of the engine and/or associated functions of the locomotive.

Further components of an embodiment of an interface device 1 may include a testing module 35 structured to facilitate the testing of the interface device 1. The testing module may be disposed in a communicating relationship with a power supply 50 and/or a voltmeter 60.

Figure 5:
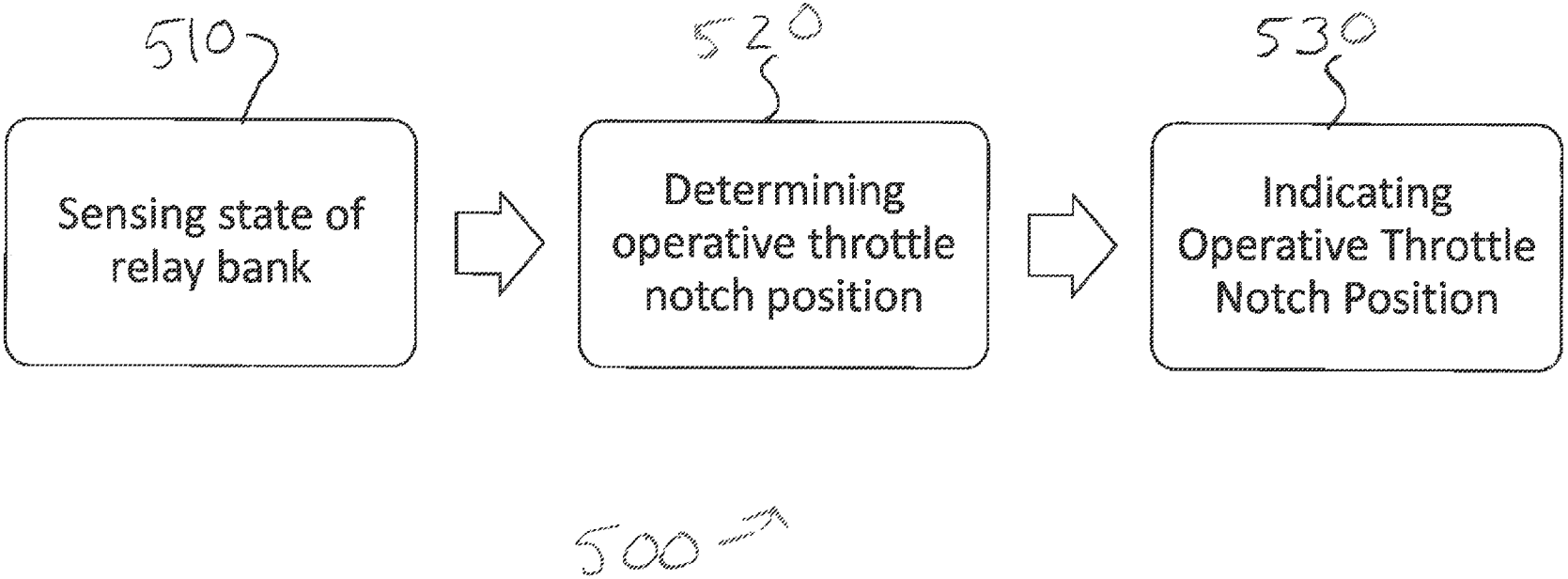
FIG. 5 is a schematic representation of a method for determining an operation throttle notch position from a plurality of throttle notch positions.

With reference to FIG. 5, the present invention is further directed toward a method 500 for determining the operative throttle notch position from a plurality of selectable throttle notch positions. Various steps of the method 500 may be performed on any suitable interface device, such as but not limited to any embodiment of an interface device as set forth herein.

The method 500 comprises sensing the state of a relay bank of a locomotive engine, as indicated at 510. The method 500 further comprises determining the operative throttle notch position in accordance with the state of the relay bank, as at 520. In addition, the method 500 comprises indicating the operative throttle notch position, as at 530. Moreover, the method 500 may be performed on an interface device configured for determination of the operative throttle notch position of a locomotive engine designated 14.

Additionally, the method 500 may comprise any combination of:

1) sensing the state of the relay bank being 0000 and indicating the operative throttle notch position being a first throttle notch position;

2) sensing the state of the relay bank being 1000 and indicating the operative throttle notch position being second throttle notch position;
3) sensing the state of the relay bank being 0010 and indicating the operative throttle notch position being a third throttle notch position;
4) sensing the state of the relay bank being 1010 and indicating the operative throttle notch position being a fourth throttle notch position;
5) sensing the state of the relay bank being 0111 and indicating the operative throttle notch position being a fifth throttle notch position;
6) sensing the state of the relay bank being 1111 and indicating the operative throttle notch position being a sixth throttle notch position.
7) sensing the state of the relay bank being 0110 comprising sensing the state of the relay bank being a seventh throttle notch position; and
8) sensing the state of the relay bank being 1110 and indicating the operative throttle notch position being an eighth throttle notch position.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An interface device disposed in a communicating relationship with a locomotive engine, said interface device comprising:

at least one sensor disposed in a sensing relationship with a relay bank of the locomotive engine and structured for determination of a state of said relay bank, said one sensor being structured to determine a corresponding throttle notch position of the locomotive engine from the state of said relay bank, at least one indicator in a communicating relationship with said one sensor and structured to indicate the corresponding throttle notch position, and said one sensor comprising at least one optical isolator.

2. An interface device as recited in claim 1, wherein said one sensor is structured to determine a first throttle notch position from a state of said relay bank being 0000.

3. An interface device as recited in claim 2, wherein said one sensor is structured to determine a second throttle notch position from a state of said relay bank being 1000.

4. An interface device as recited in claim 3, wherein said one sensor is structured to determine a third throttle notch position from a state of said relay bank being 0010.

5. An interface device as recited in claim 4, wherein said one sensor is structured to determine a fourth throttle notch position from a state of said relay bank being 1010.

6. An interface device as recited in claim 5, wherein said one sensor is structured to determine a fifth throttle notch position from a state of said relay bank being 0111.

7. An interface device as recited in claim 6, wherein said one sensor is structured to determine a sixth throttle notch position from a state of said relay bank being 1111.

8. An interface device as recited in claim 7, wherein said one sensor is structured to determine a seventh throttle notch position from a state of said relay bank being 0110.

9. An interface device as recited in claim 8, wherein said one sensor is structured to determine an eighth throttle notch position from a state of said relay bank being 1110.

10. An interface device as recited in claim 1, said one sensor being structured to determine the throttle notch position of a General Electric 7FDL Engine.

11. An interface device as recited in claim 1, said sensor comprising at least one encoder.

* * * * *